United States Patent [19]

Meredith

[11] 4,229,252

[45] Oct. 21, 1980

[54] ADDITIVES FOR OZONE BLEACHING

[75] Inventor: Michael D. Meredith, Federal Way, Wash.

[73] Assignee: Weyerhaeuser Company, Tacoma, Wash.

[21] Appl. No.: 2,491

[22] Filed: Jan. 11, 1979

[51] Int. Cl.[2] ..... D21C 9/10

[52] U.S. Cl. ..... 162/65; 162/77

[58] Field of Search ..... 162/65, 77

[56] References Cited

U.S. PATENT DOCUMENTS 4,004,967 1/1977 Swan et al. ..... 162/77

OTHER PUBLICATIONS

Empire State Paper Research Institute, Research Report No. 54 (10-1-71); Supplement to Research Report No. 53 (Apr. 12-71), Reserch Report No. 56 (May 1, 1972).

Kamashima et al., Japan Tappi 30, No. 7, 381-391 (7/76).

Kamashima et al., Japan Tappi 31, No. 9, 664-672 (9/77).

Kamishima et al., Japan Tappi 31, No. 10, 699-706 10-77.

*Primary Examiner*—William F. Smith

[57] ABSTRACT

In bleaching wood pulp with ozone a small amount of alcohol enhances the bleaching. The effect appears to be most pronounced with aliphatic alcohols having the hydroxyl group on an end carbon. The concentration of alcohol is in the range of 0.0000001 to 0.03 moles per liter of the liquid phase.

14 Claims, 5 Drawing Figures

ADDITIVES FOR OZONE BLEACHING

BACKGROUND OF THE INVENTION

1. Field of the Invention

Bleaching cellulosic wood pulp with ozone.

2. Review of the Prior Art

There is a great amount of prior art describing bleaching with ozone.

A recent patent is U.S. Pat. No. 4,080,249 which describes a number of conditions for bleaching wood pulp with ozone. Another recent patent, Eckert U.S. Pat. No. 4,119,486, describes bleaching with ozone in the presence of a cationic surfactant.

Kamishima "Ozone Bleaching of Kraft Pulp With the Addition of Methanol as Cellulose Protector," Japan TAPPI 31 No. 10, pp. 699–706 describes using methanol, in amounts of 80 to 100% of the weight of the pulp, to improve the viscosity of ozone-treated pulp. The examples have liquid phases ranging from 100% methanol to approximately 27% by weight methanol in water, equivalent to around 24.75 to around 7.8 moles methanol per liter of the liquid phase.

A second article dealing with additives in ozone bleaching is Osawa and Schuerch "The Action of Gaseous Reagents on Cellulosic Materials 1. Ozonization and Reduction of Unbleached Kraft Pulp," TAPPI February 1963, Vol. 46, No. 2, pp. 79–84. The additives were nitromethane and methyl acetate.

BRIEF SUMMARY OF THE INVENTION

It has been found that, during pulp bleaching with ozone, certain alcohols enhance the efficiency of the ozone and the bleachability of pulp. The concentration of alcohol is between 0.0000001 and 0.03 moles per liter of the liquid phase. A low-consistency ozone bleaching system would normally be used.

DETAILED DESCRIPTION OF THE PREFERRED EMBODIMENT

Figure 1:
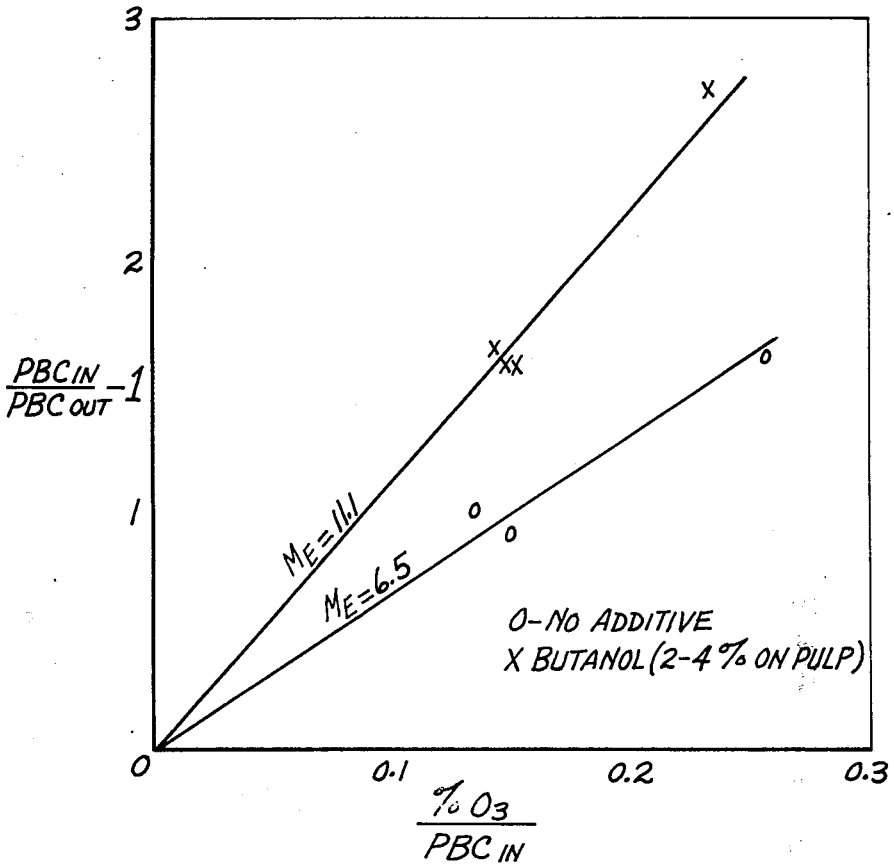
FIG. 1 is a graph comparing the efficiency factor of control samples and treated samples.

The following definitions will be used in this application.

Pulping is the changing of wood chips or other wood particulate matter to fibrous form. Chemical pulping requires cooking of the chips in solution with a chemical, and includes partial removal of the coloring matter such as lignin associated with the wood.

Bleaching is the treatment of cellulosic fibers to remove or alter the coloring matter associated with the fibers to allow the fiber to reflect white light more truly.

Consistency is the amount of fiber in a slurry, expressed as a percentage of the total weight of the oven dry fiber and the solvent in the slurry, usually water.

The consistency of the pulp will depend upon the type of dewatering equipment used. The following definitions are based on those found in Rydholm *Pulping processes,* Interscience Publishers, 1965, pages 862–863 and TAPPI Monograph No. 27, "The Bleaching of Pulp," Rapson editor, The Technical Association of Pulp and Paper Industry, 1963, pp. 186–187.

Low consistency is from 0–6%, usually between 3 and 5%. It is a suspension that is pumpable in an ordinary centrifugal pump and is obtainable using deckers and filters without press rolls.

Medium consistency is between 6 and 20%. However, 15% is a dividing point within the medium-consistency range. Below 15%, the consistency can be obtained by filters. Above 15%, press rolls are needed for dewatering. Rydholm states that the usual range for medium consistency is 10–18%, while Rapson states it is 9–15%. The slurry is pumpable by special machinery even though it is still a coherent liquid phase at higher temperature and some compression. The consistency of a slurry from a washer, either brownstock washer or a bleaching stage washer, is 9–13%.

High consistency is from 20–40%. Rydholm states that the usual range is 25–35% and Rapson states that the range is from 20–35%. This consistency is obtainable only by presses. The liquid phase is completely absorbed by the fibers. The pulp is nonpumpable but for very short distances.

The efficacy of a bleaching process is defined by a delignification factor or a brightness factor.

There are many methods of measuring the degree of delignification of the pulp, but most are variations of the permanganate test.

The normal permanganate test provides a permanganate number of Kappa number—the number of cubic centimeters of tenth normal potassium permanganate solution consumed by one gram of oven dry pulp under specified conditions. It is determined by TAPPI Standard Test T 214.

The Kappa number is similar to the permanganate number but is measured under carefully controlled conditions and corrected to be the equivalent of 50% consumption of the permanganate solution in contact with the specimen. This test gives the degree of delignification of pulps through a wider range of delignification than does the permanganate number. It is determined by TAPPI Standard Test T-236. Screened samples were used in the determination of the Kappa number.

PBC is also a permanganate test. The test is as follows:

1. Slurry about 5 wand-squeezed grams of pulp stock in a 600-milliliter beaker and remove all shives.
2. Form a hand sheet in a 12.5-centimeter Buckner funnel, washing with an additional 500 milliliters of water. Remove the filter paper from the pulp.
3. Dry the hand sheet for 5 minutes at 210°–220° F.
4. Remove the hand sheet and weigh 0.426 grams. The operation should be done in a constant time of about 45 seconds to ensure the moisture will be constant, since the dry pulp absorbs more moisture.
5. Slurry the weighed pulp sample in a 1-liter beaker container 700 milliliters of 25° C. tap water.
6. Add 25 milliliters of 4 N sulphuric acid and 25 milliliters of 0.1000 N potassium permanganate. Start the timer at the start of the permanganate addition.
7. Stop the reaction after exactly 5 minutes by adding 10 milliliters of the 5% potassium iodide solution.
8. Titrate with 0.1000 N sodium thiosulfate. Add a starch indicator near the end of the titration when the solution becomes straw color. The end point is when the blue color disappears.

In running the test, the first part of the thiosulfate should be added as rapidly as possible to prevent the liberation of free iodine. The final part of the titration is completed dropwise until the blue color just disappears. The titration should be completed as rapidly as possible to prevent reversion of the solution from occurring.

The PBC number represents the pounds of chlorine needed to completely bleach one hundred pounds of air dried pulp at 20° C. in a single theoretical bleaching stage and is equal to the number of milliliters of potassium permanganate consumed as determined by subtracting the number of milliliters of thiosulfate consumed from the number of milliliters of potassium permanganate added.

Many variables affect the test, but the most important are the sample weight, the reaction temperature and the reaction time.

There are also a number of methods of measuring pulp brightness. It usually is a measure of reflectivity and its value is expressed as a percent of some scale. A standard method is GE brightness which is expressed as a percentage of the maximum GE brightness as determined by TAPPI Standard Method TPD-103.

The degree of bleaching may be determined by either the delignification factor or the brigtness. There appears to be no correlation between the two because one is a measure of lignin within the pulp and the other is a measure of reflectivity of the pulp sheet. The delignification factor tends to be less precise when only small amounts of lignin are present in the pulp; i.e., toward the end of the bleaching process. The brightness factor tends to be less precise when the pulp is dark and its reflectiveity is low.

In this application, a "water soluble alcohol" is one that is soluble to some extent in water.

With this as background, we may now turn to the present invention. A number of tests were made to determine whether alcohol had any effect when cellulosic wood pulp was bleached with ozone.

A first series of test, Table I, used as a raw material kraft pulp which had been bleached with chlorine and extracted with sodium hydroxide in the mill. In these tests, 20 grams of pulp was mixed with 2 liters of water to create a pulp slurry having a 1% consistency. The alcohol was added to the slurry and the slurry then treated with ozone. Table I indicates the kind of alcohol added, and the amount of alcohol added either in milliliters or as a percentage of the oven dry weight of the pulp, and then in grams, grams per liter and moles per liter in the liquid phase. The table also shows the amount of ozone charged and consumed. The amount of ozone added is shown as a percentage of the oven dry weight of the pulp. Also in the table are the entering and exiting PBC and viscosity for those examples in which this information was obtained and the Meredith efficiency factor. The Meredith efficiency factor, $E_M$, is determined by the equation $$\frac{PBC_{In}}{PBC_{Out}} = 1 + E_M \frac{(O_3 \text{ Consumed})}{(PBC_{In})}$$

The second series of tests, Table II, used as a raw material a kraft pulp bleached with oxygen. In examples 22–34 and 42–57, 20 grams of pulp at 1% consistency was again used. Examples 35–41 are pilot plant runs. The pulp was at 0.55% consistency in these runs. These runs have been placed on a 2-liter basis to comform these examples to others. The other information is the same as in Table I.

Figure 2:
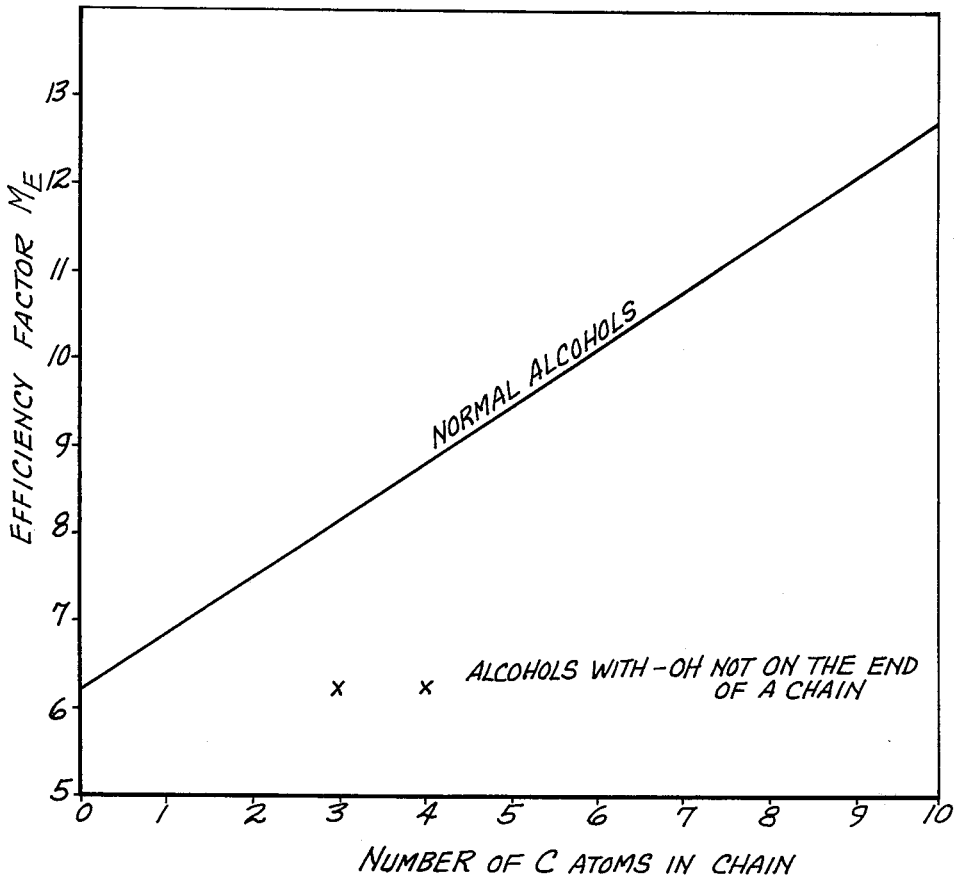
FIG. 2 is a graph comparing the efficiency factor with the chain length of various alcohols added to the system.

Some of the results of these tests in Table I and Table II are given in FIGS. 1 and 2.

In FIG. 1 the Meredith efficiency factor is the slope of the curve. It may be seen that the slope increases from 6.5 when no additive is used to 11.1 when an additive is used.

FIG. 2 compares the Meredith efficiency factor with the number of carbon atoms in the alcohol chain. It can be seen that the higher alcohols give a greater Meredith efficiency factor. This is true for normal primary alcohols. The Meredith efficiency factor is less when the hydroxyl group is not on the end carbon of the chain, as shown by the two points below the line.

TABLE I

| | | Additive | | | | | Ozone % | | PBC | | Meredith Efficiency | Viscosity | |
|---|---|---|---|---|---|---|---|---|---|---|---|---|---|
| Ex. | Chemical | % | ml. | gm. | gm/L | moles/L | Chg. | Cons. | In | Out | Factor | In | Out |
| 1. | Control | — | — | — | — | — | 2.0 | 0.78 | 2.2 | 0.60 | 7.52 | 412 | 69.8 |
| 2. | 1-butanol | — | 0.5 | 0.4 | 0.2 | 0.00275 | 2.0 | 0.54 | 2.2 | 0.57 | 11.8 | 412 | 76.5 |
| 3. | 2-propanol | — | 0.5 | 0.4 | 0.2 | 0.00335 | 2.0 | 0.69 | 2.2 | 0.59 | 8.7 | 412 | 74.8 |
| 4. | 2-methyl-1-propanol | — | 0.5 | 0.4 | 0.2 | 0.0027 | 2.0 | 0.56 | 2.2 | 0.64 | 9.5 | 412 | 77.5 |
| 5. | 2-methyl-1-propanol | — | 0.5 | 0.4 | 0.2 | 0.0027 | 4.0 | 0.86 | 2.2 | 0.59 | 6.9 | 412 | 60.1 |
| 6. | Control | — | — | — | — | — | 2.0 | 0.60 | 2.2 | 0.62 | 9.3 | 412 | 80.2 |
| 7. | 1-butanol | 0.1 | — | 0.02 | 0.01 | 0.000135 | 2.0 | 0.52 | 2.2 | 0.59 | 11.54 | 412 | 79.9 |
| 8. | 1-butanol | 0.25 | — | 0.05 | 0.025 | 0.000338 | 2.0 | 0.58 | 2.2 | 0.60 | 10.1 | 412 | 83.1 |
| 9. | 1-butanol | 0.50 | — | 0.1 | 0.05 | 0.000676 | 2.0 | 0.54 | 2.2 | 0.63 | 10.1 | 412 | 79.5 |
| 10. | 1-butanol | 1.00 | — | 0.2 | 0.1 | 0.00135 | 2.0 | 0.63 | 2.2 | 0.63 | 8.7 | 412 | 80.7 |
| 11. | 1-butanol | 2.00 | — | 0.4 | 0.2 | 0.0027 | 2.0 | 0.56 | 2.2 | 0.61 | 10.2 | 412 | 85.5 |
| 12. | Control | — | — | — | — | — | 2.0 | 0.62 | 2.2 | 0.58 | 9.9 | 412 | 77.0 |
| 13. | 1-butanol | 1.0 | — | 0.2 | 0.1 | 0.00135 | 2.0 | 0.53 | 2.2 | 0.54 | 12.8 | 412 | 80.3 |
| 14. | 1-butanol | 2.0 | — | 0.4 | 0.2 | 0.0027 | 2.0 | 0.51 | 2.2 | 0.52 | 13.9 | 412 | 80.9 |
| 15. | 1-butanol | 4.0 | — | 0.8 | 0.4 | 0.0054 | 2.0 | 0.57 | 2.2 | 0.53 | 12.2 | 412 | 86.3 |
| 16. | Control | — | — | — | — | — | 1.0 | 0.73 | 2.2 | 0.66 | 7.03 | 412 | 65.9 |
| 17. | 2-methyl-1-propanol | — | 0.5 | 0.4 | 0.2 | 0.0027 | 1.0 | 0.48 | 2.2 | 0.65 | 10.93 | 412 | 100.0 |
| 18. | Control | — | — | — | — | — | 1.0 | 0.66 | 2.2 | 0.69 | 7.29 | 412 | 115.0 |
| 19. | 2-methyl-1-propanol | 2.0 | — | 0.4 | 0.2 | 0.0027 | 1.0 | 0.48 | 2.2 | 0.66 | 10.67 | 412 | 106.0 |
| 20. | Control | — | — | — | — | — | 2.0 | 0.59 | 2.2 | 0.64 | 8.70 | 412 | 90.8 |
| 21. | 2-methyl-1-propanol | 2.0 | — | 0.4 | 0.2 | 0.0027 | 2.0 | 0.51 | 2.2 | 0.63 | 10.75 | 412 | 89.9 |

TABLE II

| Ex. | Chemical | Additive % | Additive ml. | Additive gm. | Additive gm/L | Additive moles/L | Ozone % Chg. | Ozone % Cons. | PBC In | PBC Out | Meredith Efficiency Factor | Viscosity In | Viscosity Out |
|---|---|---|---|---|---|---|---|---|---|---|---|---|---|
| 22. | Control | — | — | — | — | — | 2.0 | 1.04 | 6.53 | 2.92 | 7.8 | 348 | 112.0 |
| 23. | 1-butanol | 1.0 | — | 0.2 | 0.1 | 0.00135 | 2.0 | 1.20 | 6.53 | 2.50 | 8.8 | 348 | 96.0 |
| 24. | 1-butanol | 2.0 | — | 0.4 | 0.2 | 0.0027 | 2.0 | 1.21 | 6.53 | 2.42 | 9.2 | 348 | 98.6 |
| 25. | 1-butanol | 4.0 | — | 0.8 | 0.4 | 0.0054 | 2.0 | 1.21 | 6.53 | 2.32 | 9.8 | 348 | 91.7 |
| 26. | Control | — | — | — | — | — | 1.33 | 0.76 | 6.53 | 4.04 | 5.3 | 348 | 156.0 |
| 27. | 1-butanol | 2.0 | — | 0.4 | 0.2 | 0.0027 | 1.33 | 0.86 | 6.53 | 3.74 | 5.7 | 348 | 137.0 |
| 28. | Control | — | — | — | — | — | 3.0 | 1.25 | 6.7 | 2.9 | 7.02 | 328 | — |
| 29. | 2-propanol | 1.0 | — | 0.2 | 0.1 | 0.00167 | 3.0 | 1.40 | 6.7 | 2.5 | 8.04 | 328 | 91.4 |
| 30. | 2-propanol | 5.0 | — | 1.0 | 0.5 | 0.00833 | 3.0 | 1.34 | 6.7 | 1.9 | 12.63 | 328 | 79.6 |
| 31. | 2-propanol | 10.0 | — | 2.0 | 1.0 | 0.0167 | 3.0 | 1.63 | 6.7 | 2.2 | 8.40 | 328 | 88.3 |
| 32. | 1-butanol | 1.0 | — | 0.2 | 0.1 | 0.0135 | 3.0 | 1.50 | 6.7 | 2.1 | 9.78 | 328 | 78.2 |
| 33. | 1-butanol | 5.0 | — | 1.0 | 0.5 | 0.0676 | 3.0 | 1.57 | 6.7 | 1.7 | 10.78 | 328 | 83.6 |
| 34. | 1-butanol | 10.0 | — | 2.0 | 1.0 | 0.0135 | 3.0 | 1.65 | 6.7 | 1.8 | 11.05 | 328 | 84.5 |
| 35. | Control | — | — | — | — | — | | 0.96 | 7.11 | 3.59 | 7.3 | 333 | 114.0 |
| 36. | 1-butanol | 2.0 | — | 0.22 | 0.11 | 0.00149 | | 1.07 | 7.11 | 2.77 | 10.4 | 333 | 82.4 |
| 37. | Control | — | — | — | — | — | | 1.03 | 7.11 | 3.76 | 6.2 | 333 | 125.0 |
| 38. | Control | — | — | — | — | — | | 1.81 | 7.11 | 2.70 | 6.4 | 333 | 73.2 |
| 39. | 1-butanol | 2.0 | — | 0.22 | 0.11 | 0.00149 | | 1.65 | 7.11 | 1.92 | 11.7 | 333 | 54.0 |
| 40. | 1-butanol | 2.0 | — | 0.22 | 0.11 | 0.00149 | | 1.01 | 7.11 | 2.69 | 11.6 | 333 | 82.1 |
| 41. | 1-butanol | 4.0 | — | 0.44 | 0.22 | 0.00297 | | 1.03 | 7.11 | 2.74 | 11.0 | 333 | 78.2 |
| 42. | Control | — | — | — | — | — | 3.0 | 1.56 | 4.76 | 1.52 | 6.50 | — | — |
| 43. | Control | — | — | — | — | — | 3.0 | 1.57 | 4.76 | 1.58 | 6.10 | — | — |
| 44. | Methanol | — | 0.2 | .1728 | 0.0864 | 0.0027 | 3.0 | 1.54 | 4.76 | 1.38 | 7.57 | — | — |
| 45. | Ethanol | — | 0.3 | .248 | 0.124 | 0.0027 | 3.0 | 1.41 | 4.76 | 1.41 | 7.20 | — | — |
| 46. | 1-propanol | — | 0.4 | .324 | 0.162 | 0.0027 | 3.0 | 1.67 | 4.76 | 1.26 | 7.91 | — | — |
| 47. | 2-propanol | — | 0.33 | .26 | 0.13 | 0.00215 | 3.0 | 1.69 | 4.76 | 1.50 | 6.12 | — | — |
| 48. | 1-butanol | — | 0.49 | .4 | 0.2 | 0.0027 | 3.0 | 1.66 | 4.76 | 1.12 | 9.32 | — | — |
| 49. | 2-butanol | — | 0.49 | .4 | 0.2 | 0.0027 | 3.0 | 1.79 | 4.76 | 1.41 | 6.32 | — | — |
| 50. | 2-methyl-2-propanol | — | 0.51 | .4 | 0.2 | 0.0027 | 3.0 | 1.78 | 4.76 | 1.18 | 8.11 | — | — |
| 51. | 1-pentanol | — | 0.58 | .475 | 0.2375 | 0.0027 | 3.0 | 1.86 | 4.76 | 1.43 | 5.96 | — | — |
| 52. | 1-hexanol | — | 0.68 | .558 | 0.279 | 0.00275 | 3.0 | 1.94 | 4.76 | 0.89 | 10.67 | — | — |
| 53. | 1-heptanol | — | 0.76 | .627 | 0.3135 | 0.0027 | 3.0 | 1.36 | 4.76 | 1.23 | 10.04 | — | — |
| 54. | 2-methyl-1-propanol | — | — | .5 | 0.25 | 0.0034 | 3.0 | 1.35 | 4.76 | 0.93 | 14.52 | — | — |
| 55. | Control | — | — | — | — | — | 2.0 | 0.96 | 5.27 | 2.20 | 7.69 | 235 | 95.7 |
| 56. | 1-butanol | — | 1.0 | .809 | 0.4045 | 0.0067 | 2.0 | 1.16 | 5.27 | 1.48 | 11.62 | 235 | 94.0 |
| 57. | 1,2-ethenediol | — | 1.0 | 1.113 | 0.5565 | 0.009 | 2.0 | 1.1 | 5.27 | 2.15 | 6.95 | 235 | 115.0 |

Certain of the samples were checked for brightness. The results of these tests are in Table III.

TABLE III

| Ex. | Brightness In | Brightness Out |
|---|---|---|
| 1. | 30.9 | 67.7 |
| 2. | 30.9 | 66.0 |
| 3. | 30.9 | 66.9 |
| 6. | — | 65.0 |
| 7. | — | 65.8 |
| 8. | — | 64.2 |
| 9. | — | 65.4 |
| 10. | — | 65.0 |
| 11. | — | 64.4 |
| 55. | 28.3 | 52.1 |
| 56. | 28.3 | 58.3 |
| 57. | 28.3 | 50.5 |

Several experiments were made to determine whether temperature or pH affected the result. Table IV gives the results for temperature. It was found that the Meredith efficiency factor, when using alcohol, was independent of temperature. Table IV discloses the results of varying the pH. It was found that the Meredith efficiency factor does change as the pH changes, and there is a definite change around pH 5–6. In these experiments, 20 grams of pulp in 2 liters of water was bleached. In the temperature experiments, the pH of the slurry was 3. The amount of butanol and ozone is a percentage based on the oven dry weight of the pulp fiber.

Figure 3:
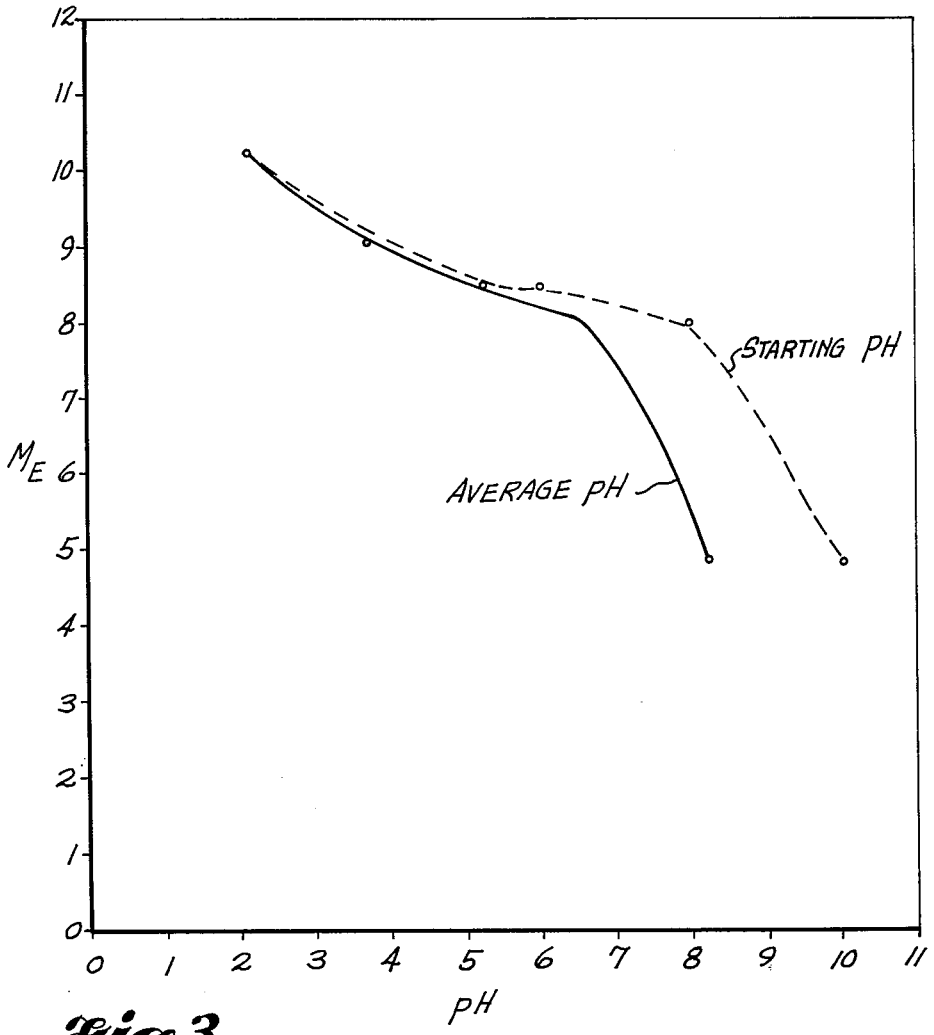
FIG. 3 is a graph comparing efficiency factor with pH.

FIG. 3 is a plot of the data in Table V. The dotted line is the starting pH, and the solid line is the average of the initial and final pH's. The rapid decrease in the Meredith efficiency factor as the system passes from an acid to an alkaline pH is graphically illustrated.

TABLE IV

| Ex. | Chemical | Additive % | Additive gm. | Additive gm/L | Additive moles/L | Ozone % Chg. | Ozone % Cons. | Temp. °C. | PBC In | PBC Out | Meredith Efficiency Factor | Viscosity In | Viscosity Out |
|---|---|---|---|---|---|---|---|---|---|---|---|---|---|
| 58. | Control | — | — | — | — | 3 | 1.29 | 50–53 | 4.5 | 2.11 | 3.95 | — | 55.3 |
| 59. | 1-butanol | 1 | 0.2 | 0.1 | 0.0135 | 3 | 1.53 | 5–11 | 4.5 | 1.32 | 7.09 | — | 50.0 |
| 60. | 1-butanol | 1 | 0.2 | 0.1 | 0.135 | 3 | 1.77 | 20–22 | 4.5 | 1.23 | 6.76 | — | 50.8 |
| 61. | 1-butanol | 1 | 0.2 | 0.1 | 0.0135 | 3 | 1.40 | 47–50 | 4.5 | 1.44 | 6.83 | — | 67.6 |

TABLE V

| Ex. | Chemical | Additive % | Additive gm. | Additive gm/L | Additive moles/L | Ozone % Chg. | Ozone % Cons. | pH In | pH Out | PBC In | PBC Out | Meredith Efficiency Factor | Viscosity In | Viscosity Out |
|---|---|---|---|---|---|---|---|---|---|---|---|---|---|---|
| 62. | 1-butanol | 1 | 0.2 | 0.1 | 0.0135 | 3 | 1.58 | 2.1 | 2.1 | 4.5 | 0.98 | 10.2 | 189 | 56.3 |

TABLE V-continued

| Ex. | Chemical | Additive % | Additive gm. | Additive gm/L | Additive moles/L | Ozone % Chg. | Ozone % Cons. | pH In | pH Out | PBC In | PBC Out | Meredith Efficiency Factor | Viscosity In | Viscosity Out |
|---|---|---|---|---|---|---|---|---|---|---|---|---|---|---|
| 63. | 1-butanol | 1 | 0.2 | 0.1 | 0.0135 | | 1.63 | 4.0 | 3.5 | 4.5 | 1.05 | 9.07 | 189 | 51.0 |
| 64. | 1-butanol | 1 | 0.2 | 0.1 | 0.0135 | 3 | 1.51 | 6.0 | 4.5 | 4.5 | 1.17 | 8.48 | 189 | 42.2 |
| 65. | 1-butanol | 1 | 0.2 | 0.1 | 0.0135 | 3 | 1.55 | 8.0 | 5.3 | 4.5 | 1.20 | 7.98 | 189 | 43.2 |
| 66. | Control | — | — | — | — | 3 | 1.55 | 8.0 | 5.3 | 4.5 | 1.51 | 5.75 | 189 | 55.4 |
| 67. | 1-butanol | 1 | 0.2 | 0.1 | 0.0135 | 3 | 1.80 | 10.0 | 6.5 | 4.5 | 1.53 | 4.85 | 189 | 54.6 |

Another series of experiments used ozone alone as a control and compared these results with those obtained when using ozone plus butanol. These results are in Table VI. In this table, the example has been adjusted to 2 liters of water to correspond these examples to the others.

Examples 70, 71 and 72 should be compared because the bleached PBC of all three is 2.7. It may be seen that the control required 1.81% ozone while the two butanol treated samples use 1.01 and 1.03% ozone to achieve the same PBC level. It can also be seen that the exit viscosity of the control sample is less than those of the butanol tested samples. The Meredith efficiency factor of the treated sample is also greater than that of the control sample.

TABLE VI

| Ex. | Pulp % Cons. | Pulp gm. | Chemical | Additive % | Additive gm. | Additive gm/L | Additive mole/L | Ozone % Conc. | PBC In | PBC Out | Meredith Efficiency Factor | Viscosity In | Viscosity Out |
|---|---|---|---|---|---|---|---|---|---|---|---|---|---|
| 68. | 0.62 | 12.4 | — | — | — | — | — | 0.96 | 7.1 | 3.6 | 7.3 | 333 | 114 |
| 69. | 0.62 | 12.4 | — | — | — | — | — | 1.03 | 7.1 | 3.76 | 6.2 | 333 | 125 |
| 70. | 0.62 | 12.4 | — | — | — | — | — | 1.81 | 7.1 | 2.7 | 6.4 | 333 | 73 |
| 71. | 0.62 | 12.4 | 1-butanol | 2 | 0.248 | 0.124 | 0.00168 | 1.01 | 7.1 | 2.7 | 11.6 | 333 | 82 |
| 72. | 0.62 | 12.4 | 1-butanol | 4 | 0.496 | 0.246 | 0.00335 | 1.03 | 7.1 | 2.7 | 11.0 | 333 | 78 |
| 73. | 0.62 | 12.4 | 1-butanol | 2 | 0.248 | 0.124 | 0.00168 | 1.07 | 7.1 | 2.8 | 10.4 | 333 | 82.4 |
| 74. | 0.62 | 12.4 | 1-butanol | 2 | 0.248 | 0.124 | 0.00168 | 1.65 | 7.1 | 1.9 | 11.7 | 333 | 54 |
| 75. | 0.62 | 12.4 | — | — | — | — | — | 1.9 | 4.6 | 1.1 | 7.6 | 173 | 61.6 |
| 76. | 0.62 | 12.4 | 1-butanol | 1 | 0.124 | 0.062 | 0.00084 | 1.8 | 4.6 | 0.79 | 12.5 | 173 | 51 |
| 77. | 0.62 | 12.4 | 1-butanol | 0.5 | 0.062 | 0.031 | 0.00042 | 1.8 | 4.6 | 0.81 | 12.0 | 173 | 51 |
| 78. | 0.50 | 10.0 | — | — | — | — | — | 1.03 | 4.5 | 1.62 | 7.8 | 181 | 57.4 |
| 79. | 0.50 | 10.0 | — | — | — | — | — | 1.3 | 4.5 | 1.21 | 9.4 | 181 | 51.8 |
| 80. | 0.50 | 10.0 | 1-butanol | 1 | 0.1 | 0.05 | 0.00068 | 0.995 | 4.5 | 1.13 | 13.5 | 181 | 48.1 |
| 81. | 0.45 | 9.0 | — | — | — | — | — | 1.106 | 3.45 | 0.95 | 8.6 | 176 | 53.5 |
| 82. | 0.45 | 9.0 | 1-butanol | 1 | 0.09 | 0.045 | 0.00061 | 0.77 | 3.45 | 1.2 | 8.8 | 176 | 59.2 |
| 83. | 0.45 | 9.0 | 1-butanol | 1 | 0.09 | 0.045 | 0.00061 | 1.03 | 3.45 | 0.75 | 12.1 | 176 | 50.5 |
| 84. | 0.45 | 9.0 | 1-butanol | 1 | 0.09 | 0.045 | 0.00061 | 1.22 | 3.45 | 0.65 | 12.2 | 176 | 46.9 |
| 85. | 0.49 | 9.8 | — | — | — | — | — | 0.91 | 3.45 | 0.91 | 10.5 | 176 | 54.0 |
| 86. | 0.49 | 9.8 | 1-butanol | 1 | 0.098 | 0.049 | 0.00066 | 0.71 | 3.45 | 0.83 | 15.2 | 176 | 47.7 |
| 87. | 0.49 | 9.8 | 1-butanol | 1 | 0.098 | 0.049 | 0.00066 | 0.95 | 3.45 | 0.66 | 15.3 | 176 | 44.9 |
| 88. | 0.55 | 11.0 | 1-butanol | 1 | 0.11 | 0.055 | 0.00074 | 1.11 | 3.45 | 0.58 | 15.3 | 176 | 42.6 |

Certain of the samples were then extracted using sodium hydroxide. The results are given in Table VII.

TABLE VIII

| Ex. | PBC after Extraction | Meredith Efficiency Factor after Extraction | Viscosity after Extraction |
|---|---|---|---|
| 65. | 0.94 | 9.5 | 54 |
| 66. | 0.64 | 16.0 | 46.4 |
| 67. | 0.67 | 15.1 | 46.4 |
| 71. | 0.49 | 22.7 | 48.8 |
| 72. | 0.56 | 16.8 | 52.2 |
| 73. | 0.49 | 25.0 | 46.1 |
| 74. | 0.71 | 17.4 | 61.8 |
| 75. | 0.41 | 26.9 | 41.8 |
| 76. | 0.42 | 24.2 | 49.6 |
| 77. | 0.38 | 25.0 | 38.9 |
| 78. | 0.34 | 25.9 | 43.2 |

From this, it has been determined that the amount of butanol which would be used per liter of the liquid phase would be 0.00001 to 2.25 grams or 0.0000001 to 0.03 moles, the preferred range of butanol being from 0.01 to 0.20 grams or 0.0001 to 0.0027 moles, and the optimum amount being around 0.05 grams or 0.007 moles and the optimum range being 0.01 to 0.005 moles. Other water-soluble alcohols may be used in the same molar amounts. Normal alcohol is considered to be better than a branched chain alcohol but both are usable. Cyclic alcohols, such as cyclohexanol, may also be used. An alcohol with the hydroxyl radical on an end carbon appears to be most effective, though alcohols with hydroxyl radical located elsewhere in the chain can also be effective. Saturated alcohols will not react with ozone as the unsaturated will. Cyclic alcohols will act in the same manner as corresponding aliphatic alcohols. The polyhydric alcohols are considered to be less satisfactory than the monohydric alcohols, though some appear to increase the viscosity and physical properties. The preferred alcohols are water soluble, straight chain, aliphatic and saturated.

The increase in viscosity noted in some of the experiments indicates that the physical properties of the pulp - fold, tear, burst, etc.—will also be enhanced.

It is preferred that the pulp be at a consistency of 0.01% to 4.9%. The most effective consistency is considered to be in the range of 0.01% to around 0.7%, and preferably around 0.37%. In this range, the ozone would be mixed with the pulp using either a mixing energy of 0.002 to 0.2 horsepower per cubic foot of gassed slurry or a superficial velocity of ozone and carrier gas of 200 to 3,800 feet per hour. The superficial velocity is the average lineal speed of the gas through the reactor, if it were an empty reactor. It is computed by dividing the volume of gas leaving the reactor by the cross-sectional area of the reactor. The ozone would be present in the carrier gas entering the reactor in an amount equal to 0.05 to 23%, preferably 0.05 to 6%.

Figure 4:
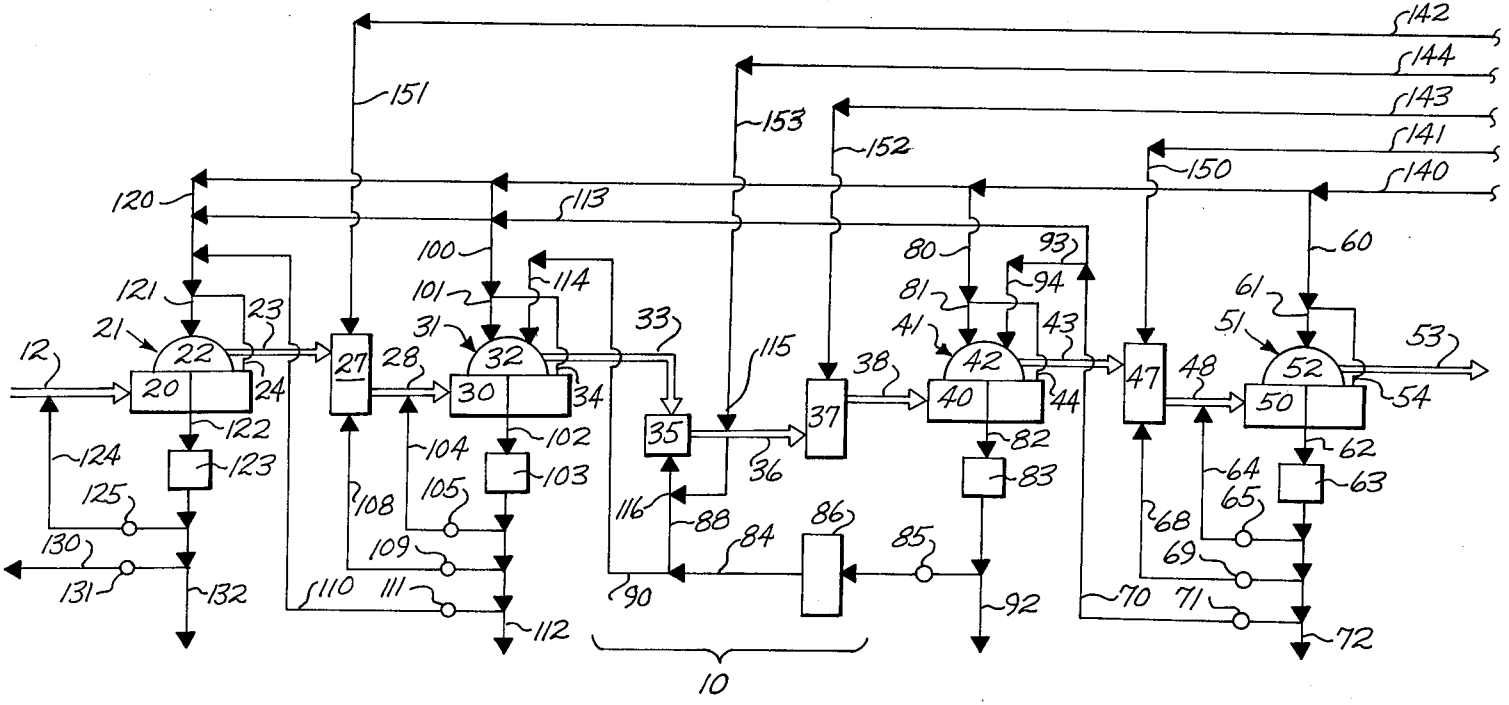
FIGS. 4 and 5 are a schematic of a system using ozone and the additive.

A bleaching stage at these low consistencies is shown in block diagram in FIG. 4. The flow of pulp through the system is shown by the double line and the flow of wash water through the system by the single line. In this discussion a consistency of 0.01% to around 0.7% in the ozone stage will be used.

The purpose of this system is to isolate the water used in the ozone reactor from the water used in other stages so that the water and alcohol may be recycled and reused in the ozone stage. This isolation is required both by the need to reuse the large amount of water required to maintain the consistency of the pulp in the range 0.01% to around 0.7%, preferably around 0.37%, and to maintain the pH of the solution.

An ozone stage 10 is shown in conjunction with stages before and after it. No specific type of chemical is indicated for these latter stages.

In this figure, we will first follow the pulp through the system and then follow the wash water through the system to show how the wash water of the ozone stage is reused and isolated from the rest of the system.

The pulp slurry 12 enters the vat 20 of washer 21 and the pulp fibers are picked up on the drum 22, carried past washer heads which spray fluid, usually water or weak filtrate, to displace the liquid in the mat with new liquid, is dewatered by vacuum and exits as pulp 23.

Each of the washers in this system operates in the same way. They are vacuum drum washers in which a vacuum drum 22 rotates through the vat 20. The drum is covered by a filter cloth. During its rotation through the pulp slurry in the vat, a vacuum pulls the fibers onto the filter cloth and the liquid in the vat through the fibers and the filter cloth into the internal piping of the drum. The liquid or filtrate is carried through a pipe central of the drum to an external pipe and into a storage or seal tank that both holds the filtrate and maintains the vacuum within the drum.

The consistency of the pulp mat will stay substantially constant during its travel on the drum after leaving the vat. As much liquid will be removed from the pulp mat by vacuum as there is washing fluid added to the mat. This removed liquid is also carried into the internal piping system of the drum. It is assumed that the washing fluid will displace the liquid in the mat, although in actual practice there will be some mixing of liquid in the mat with the washing fluid and not a complete displacement. The consistency of the slurry entering the vat 20 is usually 1 to 1½% and the consistency of the pulp 23 leaving the drum is usually 9 to 15%. The fiber mat is removed from the drum by scrapers, wires, or other means. These are then cleaned of residual fibers by a clean-up washer 24. A fluid washer is shown, although this clean-up may also be done with air.

The pulp mat 23 is then carried into a stage 27 where it is bleached or extracted with appropriate chemicals. The chemicals may be added to the mat 23 on the washer or in a later mixer. The pulp is usually diluted, heated and stored during this treatment. The treated pulp slurry 28 is then carried to the vat 30 of washer 31. Prior to entering the vat, it is again diluted to a consistency of 1 to 1½%. The dilution usually occurs in storage, and between storage and the vat. The operation of washer 31 is similar to washer 21. The drum is 32, the exiting pulp is 33, and the clean-up washer is 34.

The pulp 33 is again at a consistency of 9 to 15% and must be reduced to a consistency of 0.01% to around 0.7% before the ozone treatment. It enters the mixer 35 where it is mixed with a great quantity of water to reduce its consistency to the appropriate amount. This pulp slurry 36 then passes to ozone reactor 37 where the pulp is treated with the ozone. The treated pulp 38 then enters the vat 40 of washer 41 and is taken by the drum 42 by the washer heads and exits as washed pulp 43. It is again at a consistency of 9–15%. The clean-up washer is 44.

Pulp 43 is treated in another stage 47 and the treated pulp 48 is carried to the vat 50 of washer 51. It is again diluted to 1 to 1½% prior to entering the vat. The drum of this washer is 52, the exiting pulp is 53, and the clean-up washer is 54.

The wash water and filtrate in the system is flowed countercurrently so it may be reused within the system. It is also flowed in a manner that isolates the wash water used in stages 27 and 47 from that used in the ozone stage 37. It is assumed that stages 27 and 47 are similar so that their filtrates may be combined. This is done by using two sets of washing heads on washers 31 and 41 so that the filtrate from washer 51 may be returned to that stage or flowed into stage 27.

Fresh process water from line 60 flows both into washer heads 61 and into clean-up washer 54 and eventually through the internal piping of drum 52 and the external filtrate line 62 into seal tank or storage tank 63. The filtrate in the seal tank may be used for several purposes. It may be used to dilute the pulp 48 entering the vat 50. Line 64 and pump 65 are for this purpose. It may be used to dilute the pulp in stage 47. Line 68 and pump 69 are for this purpose. It may be used to wash the pulp mat in a preceding stage. Line 70 and pump 71 are for this purpose. It may become effluent. Line 72 is for this purpose.

The filtrate in line 70 is split. Part goes through line 93 to a set of washer heads 94 on filter drum 42. The filtrate is sprayed on the mat shortly before the pulp 43 leaves the mat. This filtrate or washing fluid will enter the pulp mat and an equal amount of liquid will be removed from the mat as filtrate through the internal piping of drum 42. However, a large proportion of the filtrate from washer heads 94 will remain with the mat and be carried with the mat 43 back into the bleach system 47. Consequently, the major portion of the filtrate from washer 41 will be from the preceding ozone stage, and a major portion of the filtrate from bleach stage 47 will not be filtrate from washer 41, but will be returned to bleach stage 47.

The rest of the filtrate from line 70 will be carried by line 113 to either washer 31 or 21.

Whether the filtrate in line 113 will be used as wash water on washer 31 will depend upon the amount of contact that can be allowed between the ozone stage filtrate and the filtrate from stage 47. If there should be no contact, then the filtrate from line 113 will go to washer 21, and fresh process water from line 100 will be used in washer 31.

In either case, the washing fluid will pass through line 100 to washer heads 101 and clean-up washer 34. The washing fluid passing through washer heads 101 will enter the pulp mat and a substantially equal amount of liquid will be removed from the pulp mat and be carried into the internal piping system of drum 32 and leave as filtrate through external line 102 into seal tank 103. The filtrate from seal tank 103 will be used in the same manner as the filtrate from seal tank 63. Line 104 and pump 105 will carry it to pulp 28 to dilute the pulp. Line 108 and pump 109 will carry it into bleaching stage 127 to dilute the pulp. Line 110 and pump 111 will carry it to washer 21 to wash the pulp. Line 112 will remove it as effluent.

The filtrate in line 113 will also be carried to washer heads 121 and clean-up washer 24 on washer 21, and be removed either as filtrate through line 122 to seal tank 123 or as liquid with the pulp 23 into the bleaching stage 27. The filtrate from washer 21 will also consist of the liquid entering with the pulp slurry and the liquid removed from the pulp mat while it is on drum 22. From seal tank 123, the filtrate will be carried through line 124 by pump 125 to be used to dilute the pulp, through line 130 by pump 131 to be used elsewhere in the process, or through line 132 as effluent.

In washer 81 of the ozone stage, the pulp mat is first washed with fresh water. The water is added through line 80 to washer head 81. The water is also supplied to clean-up washer 84. The second washing fluid is supplied through washer heads 94. During the application of washing fluid to the pulp mat by washer heads 81 and 94, there will be a removal of substantially equal amount of liquid from the pulp mat. This will be removed as filtrate through line 82. In addition, a substantial portion of the liquid entering with the pulp slurry will be removed as filtrate also. This filtrate goes into seal tank 83. From there, the filtrate is carried by line 84 and pump 85 through a heat exchanger 86 to remove excess heat from the system. Although temperature does not have an effect on the reaction, it is normal to operate ozone systems at temperatures under 50° C. It is necessary to cool the system to operate at these temperatures. The heat exchanger 86 may be used as a heat source for other streams in the system. For example, if stage 47 requires high temperatures, then heat exchanger 86 may be used to heat the fresh process water passing through line 60.

The filtrate in line 84 is split into two portions. The major portion passes through line 88 into mixer 35 where the pulp slurry is diluted from a consistency of 9 to 15% to 0.01% to around 0.7%. The remainder of the filtrate from line 84 is carried by line 90 to washer heads 114, the second set of washer heads on washer 31. The filtrate or washing fluid is added to the pulp mat and a substantially equal of liquid is removed from the pulp mat as filtrate from washer 31. Consequently, a major portion of the filtrate from washer 31 will be from the preceding stage 27 or the stage 47, and a major portion of the filtrate from the ozone stage will not leave washer 31 as filtrate 31 but will be returned to ozone stage 37 with the pulp mat. The remainder of the filtrate may be removed as effluent through line 92. This amount will equal the amount being added through line 80.

Alcohol may be added to the ozone stage at two places, either directly into the pulp slurry 36 at 115 or into the recycled filtrate in line 86 at 116. Most of the alcohol remaining in the system will be reused so only enough will be added to maintain the alcohol in the system at the chosen level. The amount of alcohol added to the system will usually be less than 10% of the total alcohol in the system, and may well be less than 5% of the total.

The filtrate would also be recycled within the stage and isolated from the surrounding stages. The purpose is to retain the great amount of liquid, water, being used within the stage, and to reduce the volume of effluent that must be treated before discharge. The recycle and isolation of the filtrate within the stage also minimizes pH adjustment. The pH of an ozone stage is acidic—1 to 7. The pH of the stages before and after the ozone stage, stages 27 and 47, will normally be alkaline—7 to 14. By isolating the ozone stage, it is possible to reduce the amount of alkaline and acidic material required for pH adjustment because the alkaline filtrate from stage 47 does not have to be rendered acidic before being used to wash the pulp mat on washer 41, and the acidic filtrate from the ozone stage does not have to be rendered alkaline before being used to wash the pulp mat on washer 31. These reasons would argue for the isolation of any ozone stage operated at low consistency.

This isolation is accomplished by the amount of washing fluid applied to the mat at the washers before and after the stage, and by the method of applying the washing fluid. The consistency of the pulp in the mat on drum 32 will usually be between 9 and 15%. For example, at a 12½% consistency the pulp mat will contain 7 tons of water for each ton of pulp, and at 10% consistency it will contain 9 tons of water for each ton of pulp. The amount of washing fluid applied by washer heads 101 and 114 should at least equal the amount of liquid in the pulp mat so that an amount of liquid equal to liquid originally in the pulp mat will be removed from the mat. If the washing fluid supplied by washer heads 101 is not neutral, then there is a second requirement. The amount of washing fluid applied by washer heads 114 should equal the amount of liquid in the mat so that an amount of liquid substantially equal to the amount of liquid in the mat prior to washer heads 114 will be removed from the mat.

This same flow pattern also occurs at washer 41. Again, the consistency of the pulp in the mat on drum 42 will be 9 to 15%. The excess water in pulp slurry 38 due to the low consistency will not be carried by the mat across drum 42 but will be drawn directly into the drum 42 from the vat 40 and be discharged through line 82. An amount of liquid in the mat substantially equal to the amount of washing fluid added by washer heads 81 and 94 will be removed from the mat and discharged as filtrate. The amount of washing fluid added by washer heads 81 and 94 should equal the amount of liquid within the mat.

Washers 31 and 41 show effluent lines 112 and 92 respectively. If a portion of the filtrate is removed as effluent, then an equal amount of liquid must be added as washing fluid at the washer. This is supplied through the first set of washer heads, washer heads 101 in washer 31 and washer heads 81 in washer 41.

The various lines bringing the process chemicals to the system are in the upper portion of the figure. Line 140 carries process water to lines 60, 80, 100 and 120. Line 141 carries chemicals to line 150 for use in stage 47 and line 142 carries chemicals to line 151 for use in stage 27. If the chemicals are the same, then the same line would supply both stages. Line 143 brings the ozone to line 152 for use in ozone stage 37 and line 144 brings the alcohol to line 153 for use in the ozone stage.

At one extreme, there could be the possibility of at least two complete changes of liquid in the pulp mat on drums 32 and 42. In this system, the amount of washing fluids added by the first set of heads 101 and 81 would equal or exceed the amount of liquid in the mat and the amount of washing fluid added by washer heads 114 and 94 would equal the amount of liquid in the mat leaving the washer. At the other extreme is the possibility of one complete change of liquid in the pulp mat on drums 32 and 42. In this instance, the washing fluid from washer heads 101 and 81 would be neutral, and the amount of washing fluid added by washer heads 101 and 114 would equal the amount of liquid in the pulp mat leaving the washer and the amount of washing fluid added by washer heads 81 and 94 would equal the amount of liquid in the pulp mat leaving the washer.

Figure 5:
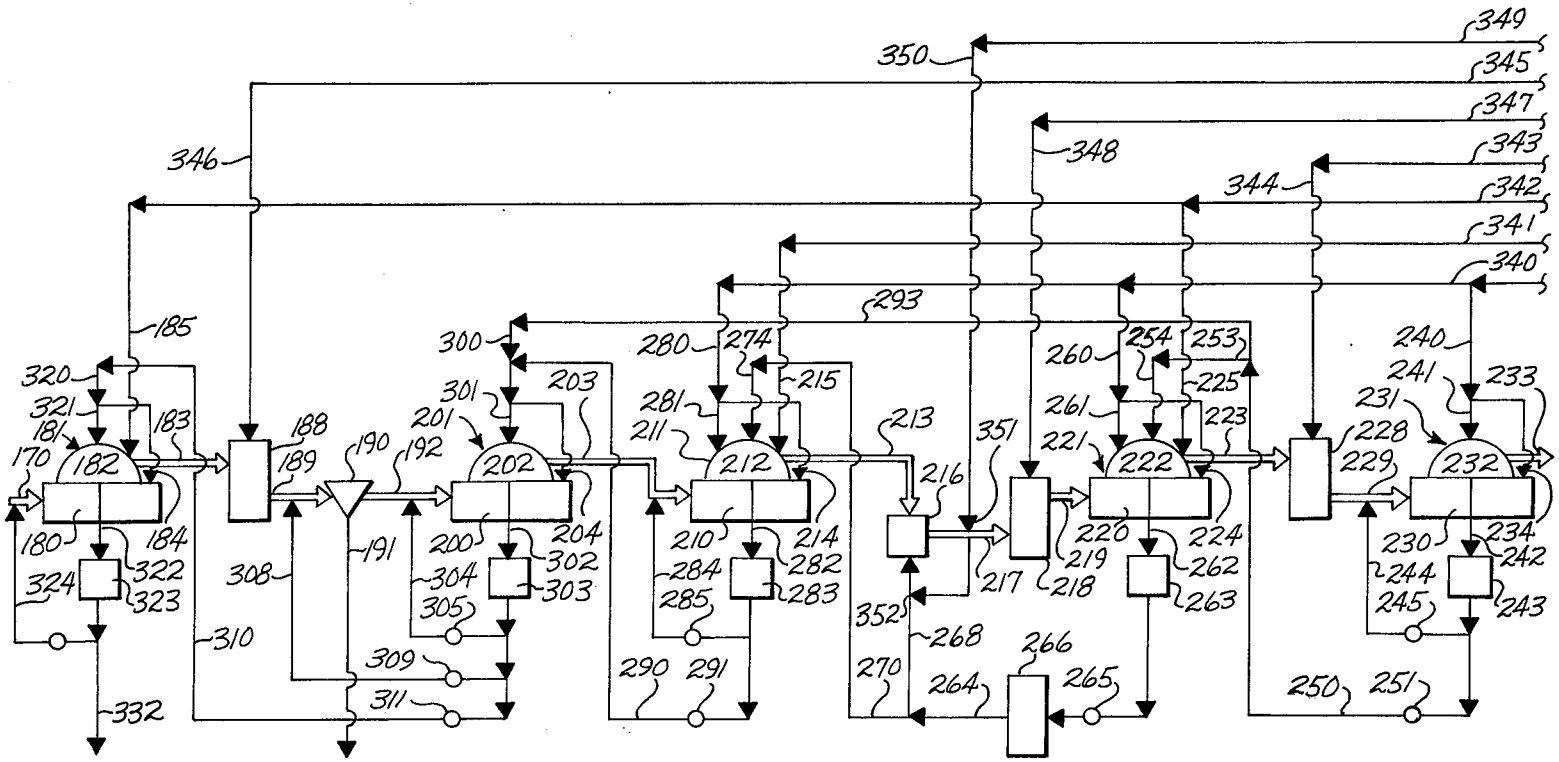

There are several possible modifications to this process and these are illustrated in FIG. 5. First, a pair of washers may be used in place of a single washer, as shown by the washers 201 and 211 which substitute for the washer 31 in FIG. 4. Second, there is some chemical transfer because this is a total counterflow system with effluent being removed from the first washer only.

To simplify this discussion, it should be remembered that the amount of liquid in a pulp mat on a filter drum will remain substantially constant so that the amount of washing fluid being added to a pulp mat by a washer head will substantially equal the amount of liquid being removed from the pulp mat as filtrate. It should also be remembered that pulp slurry will normally enter the vat of a washer at a consistency of about 1 to 1½% and the pulp mat will leave the washer at a consistency of around 9 to 15%.

We will also assume in this system that stages 188 and 228 are alkaline and the ozone stage 216 is acid, and that the ozone stage is being operated at a consistency of 0.01% to around 0.7%.

In this system, a pulp slurry 170 enters the vat 180 of washer 181 and is carried by drum 182 past washer heads 321 and the pulp mat 183 is taken from the drum 182. The clean-up washer is 184. Prior to leaving the washer drum, the pulp mat is treated with sodium hydroxide at 185 in order to adjust the pH to one appropriate for the subsequent treatment. The mat 183 is then carried to treatment 188. In this treatment, it may be heated with steam to an appropriate temperature for the treatment, diluted with filtrate to an appropriate consistency for the treatment, mixed with the chemicals and stored for a time appropriate to the treatment.

Following the treatment, the pulp slurry 189 is carried to screens 190. Prior to the screening step, the slurry is diluted to 1–2% consistency. The screens remove the larger fiber bundles and knots at 191. The screened slurry 192 is then carried to the vat 200 of washer 201. The drum 202 of the washer 201 carries the pulp mat by washer heads 301 and the pulp mat 203 is removed from the drum. The clean-up washer is 204.

The pulp enters the tank 210 of the second washer 211 in this series. The drum 212 of the washer then carries the pulp mat by two sets of washer heads. The clean-up washer is 214. Before the pulp mat 213 leaves the drum, it is treated with acid at 215 in order to adjust the pH of the mat for the ozone treatment. The pulp 213 is then diluted to a consistency of 0.01% to around 7% in mixer 216, and the low-consistency pulp slurry 217 treated with ozone at 218. The treated pulp 219 enters the vat 220 of washer 221 and the drum 222 carries the pulp mat by a split series of washer heads and the mat 223 is carried from the drum. The clean-up washer is 224. Prior to leaving the drum the mat 223 is treated with alkali at 225 to adjust the pH.

The mat 223 is carried to treatment 228. Again, the temperature of the mat may be raised, the consistency of the pulp may be lowered, and the treated pulp may be stored for an appropriate period of time. The treated pulp slurry 229 is diluted and carried to the vat 230 of the final washer 231. The drum 232 carries the pulp by washer head 241 and the pulp leaves as pulp mat 233. Again, the clean-up washer is 234.

The alkali added at 185 and 225 may be in an amount sufficient for an extraction stage which would be in excess of the usual pH adjustment. In this case, the sodium hydroxide normally used would be from ½ to 5% based on the oven dry weight of the pulp.

The filtrate flows counter to the flow of the pulp through the system. Fresh process water through line 240 is sprayed on the pulp at 241. The filtrate from washer 231 exits through line 242 into seal tank 243 and then is split. Part of the filtrate is used to dilute the pulp slurry coming into vat 230. This part is carried through line 244 by pump 245. Part of the filtrate is used to wash the pulp mat on washers 221 and 201. This part is carried through line 250 by pump 251.

The filtrate in line 250 is also split, with part being used as washing fluid on washer 221 through line 253 and the second set of washer heads 254, and part being used on washer 201 through lines 293 and 300 and washer heads 301. Fresh water is also applied to the pulp mat on drum 222 through line 260 and the first set of washer heads 261.

The filtrate from washer 221 passes through filtrate line 262 into seal tank 263, and then is carried by line 264 and pump 265 through heat exchanger 266. The heat exchanger 266 would be used to heat an incoming water stream such as that in line 240.

The filtrate in line 264 is split, with the major portion going through line 268 to mixer 216 and a small portion being carried through line 270 to the second set of washer heads 274 on washer 211. Fresh water is also applied to the mat through line 280 and the first set of washer heads 281.

The filtrate leaves washer 211 through line 282 into seal tank 283, and from there is split, one part diluting the pulp 203 entering the washer vat 210. This filtrate is carried through line 284 by pump 285. The remainder of the filtrate is carried through line 290 by pump 291 to washer heads 301 on washer 201. It is combined with the filtrate from lines 293 and 300.

The filtrate from washer 201 is carried through line 302 to seal tank 303. This filtrate is used to dilute the pulp slurry entering the vat 200. This is done through line 304 with pump 305. It is also used to dilute the pulp slurry 189 entering the screens 190. This is through line 308 and pump 309. The remainder is supplied to washer heads 321 on washer 181. It is carried through line 310 by pump 311 to line 320.

The filtrate from washer 181 is carried through line 322 to seal tank 323 and is there used both to dilute the pulp 170 entering the vat 180 through line 324 and pump 325 and carried to effluent treatment through line 332.

The lines bringing chemicals to this system are shown in the upper portion of the drawing. Line 340 brings fresh process water to line 240, 260 and 280. Line 341 brings acid to line 215. Line 342 brings alkali to lines 185 and 225. Line 343 carries chemicals to line 344 for stage 228. Line 345 carries chemicals to line 346 for treatment stage 188. Line 347 carries ozone to line 348 for use in treatment stage 218 and line 349 carries alcohol to line 350 for addition to the pulp mat 217 at 351, or to the dilution water in line 268 at 352.

The precise amounts of fresh water will depend on the specific pulp mill configuration. However, there are generalizations that can be made. The fresh water is divided approximately into three equal amounts to be added in lines 240, 260 and 280. The greater the amount of fresh water added, the less solids will be contained in the recycling slurry. Approximately all of the filtrate from line 250 will be applied at washer 221 and only a minute amount will be carried to washer 201. Because of the amounts of water being used, usually the water added at washer heads 241 will not equal the amount of the liquid in the mat on drum 232, so some of the chemical will be carried out with the mat. The amount of washing liquid added at washer 221 through washer heads 261 and 254 will equal or exceed the liquid in the pulp mat, and the washing liquid added at washers 181, 201 and 211 will normally exceed the liquid in the pulp mat.

As an example, in a system in which the pulp leaving each of the washers is at 12% consistency, the amount of fresh water added per metric ton of pulp by washer head 241 would be 4 metric tons, and by washer heads 261 and 281, 3 metric tons. The amount of filtrate from washer 231 would be 8 metric tons per metric ton of pulp, and of this 4 would be applied by washer heads 254 and 4 would be applied by washer heads 301. The amount of filtrate applied by washer heads 274 would be 7 metric tons per metric ton of pulp. The amount of washing fluid applied by washer head 301 would be 10.7 metric tons per metric ton of pulp.

What is claimed is:

1. The process of enhancing the bleaching efficiency of ozone, based on the degree of delignification, when bleaching cellulosic fiber with ozone comprising providing said fibers in a liquid phase at a consistency in the range of 0.01–4.9%, said liquid phase comprising water and a water-soluble alcohol, said alcohol being present in an amount in the range of 0.0000001 to 0.03 moles per liter of said liquid phase, and mixing an ozone-bearing gas with said liquid phase.

2. The process of claim 1 in which said alcohol is in an amount in the range of 0.0001 to 0.003 moles per liter of said liquid phase.

3. The process of claim 1 in which said alcohol is in an amount in the range of 0.01 to 0.005 moles per liter of said liquid phase.

4. The process of claim 1, 2 or 3 in which said alcohol is saturated.

5. The process of claim 1, 2 or 3 in which said alcohol is aliphatic.

6. The process of claim 1, 2 or 3 in which said alcohol is cyclic.

7. The process of claim 1, 2 or 3 in which said alcohol has a hydroxyl group on an end carbon.

8. The process of bleaching cellulosic fibers with ozone comprising reacting said fibers and ozone in the presence of a liquid phase at a consistency in the range of 0.01–4.9%, said liquid phase comprising water and a water-soluble alcohol, said alcohol being present in an amount in the range of 0.0000001 to 0.03 moles per liter of said liquid phase.

9. The process of claim 8 in which said alcohol is in an amount in the range of 0.0001 to 0.003 moles per liter of said liquid phase.

10. The process of claim 8 in which said alcohol is in an amount in the range of 0.01 to 0.005 moles per liter of said liquid phase.

11. The process of claim 8, 9 or 10 in which said alcohol is saturated.

12. The process of claim 8, 9 or 10 in which said alcohol is aliphatic.

13. The process of claim 8, 9 or 10 in which said alcohol is cyclic.

14. The process of claim 8, 9 or 10 in which said alcohol has a hydroxyl group on an end carbon.

* * * * *

UNITED STATES PATENT AND TRADEMARK OFFICE

Certificate

Patent No. 4,229,252 Patented October 21, 1980

Michael Dean Meredith

Application having been made by Michael Dean Meredith, the inventor named in the patent above identified, and Weyerhaeuser Co., Tacoma, Wash., a corp. of Washington, the assignee, for the issuance of a certificate under the provisions of Title 35, Section 256, of the United States Code, adding the name of Maharaj K. Gupta as a joint inventor, and a showing and proof of facts satisfying the requirements of the said section having been submitted, it is this 31st day of August 1982, certified that the name of the said Maharaj K. Gupta is hereby added to the said patent as a joint inventor with the said Michael Dean Meredith.

Fred W. Sherling
*Associate Solicitor*

UNITED STATES PATENT AND TRADEMARK OFFICE

CERTIFICATE OF CORRECTION

PATENT NO. : 4,229,252

DATED : October 21, 1980

INVENTOR(S) : Michael D. Meredith, Et al.

It is certified that error appears in the above-identified patent and that said Letters Patent are hereby corrected as shown below:

Column 1, line 17, "699" should read --691--

Column 2, line 32 "of" should read --or--

Column 2, line 48, "wand-squeezed" should read --hand-squeezed--

Column 6, line 40 "IV" should read --V--

Column 5, TABLE IV under "Ex. 60 moles/L colume "0.135" should read --0.0135--

Column 7, TABLE V (continued) under Ex. 63, Chg. column insert number --3-- in blank space Signed and Sealed this

*Fourteenth* Day of *December 1982*

[SEAL]

*Attest:*

GERALD J. MOSSINGHOFF

*Attesting Officer*

*Commissioner of Patents and Trademarks*